United States Patent [19]

Ferris et al.

[11] Patent Number: 4,534,567

[45] Date of Patent: Aug. 13, 1985

[54] BOARD GAME WITH CHANCE DEVICE PLAYING PIECE

[75] Inventors: Michael J. Ferris; Paul H. Wise, both of Chicago; Jeffrey D. Breslow, Highland Park, all of Ill.

[73] Assignee: Marvin Glass & Associates, Chicago, Ill.

[21] Appl. No.: 463,636

[22] Filed: Feb. 3, 1983

[51] Int. Cl.[3] ..... A63F 3/00

[52] U.S. Cl. ..... 273/255; 273/289; 273/143 E

[58] Field of Search ..... 273/255, 262, 143 E, 273/254, 251, 252, 289, 288, 282, 241, 242

[56] References Cited

U.S. PATENT DOCUMENTS

| | | | |
|---|---|---|---|
| 730,659 | 6/1903 | Hurd | 273/143 E |
| 1,762,269 | 6/1930 | Harris | 273/289 X |
| 2,749,128 | 6/1956 | Arnold | 273/255 |
| 3,167,313 | 1/1965 | Davenport et al. | 273/262 |
| 3,768,811 | 10/1973 | Goldfarb et al. | 273/261 |
| 3,865,379 | 2/1975 | Breslow | 273/256 X |
| 3,883,142 | 5/1975 | Spohn | 273/251 |
| 3,926,437 | 12/1975 | Moe et al. | 273/260 |
| 4,055,346 | 10/1977 | Garcia-Kuenzli | 273/262 |
| 4,057,253 | 11/1977 | Csoka | 273/265 X |
| 4,261,574 | 4/1981 | Rogers, Jr. | 273/253 |
| 4,317,570 | 3/1982 | Brunton | 273/246 |

FOREIGN PATENT DOCUMENTS

| | | | |
|---|---|---|---|
| 309451 | 4/1918 | Fed. Rep. of Germany | 273/242 |
| 999275 | 1/1952 | France | 273/262 |
| 413676 | 7/1934 | United Kingdom | 273/255 |
| 620546 | 3/1949 | United Kingdom | 273/254 |
| 2069345 | 8/1981 | United Kingdom | 273/255 |

*Primary Examiner*—Richard C. Pinkham
*Assistant Examiner*—Scott L. Brown
*Attorney, Agent, or Firm*—John S. Pacocha

[57] ABSTRACT

A board game in which a horizontal playing surface is defined by an array of hexagonal spaces, each space abutting the adjacent space, and a number of vertical walls disposed along lines formed by adjacent hexagonal spaces. Player start spaces are provided and a target is located on a site remote from the start spaces. Available paths of movement from space to space are limited by the walls but the player token has a marker movable parallel to the planar surface and transverse to the playing surface to pass over a wall. Both the player and the target may attack each other when they are on an aligned file of spaces, however, the target is further required to be facing the player token in order to attack. The playing spaces include defense zones armed by the presence of a defense playing piece in the form of a missile silo or cannon and activated by a chance drum borne by the target along with a number chance drum. The player's token is in the form of a plane or rocket and play is commenced with certain fuel allocations that may be increased by landing the token on fuel tanks on the playing surface.

16 Claims, 6 Drawing Figures

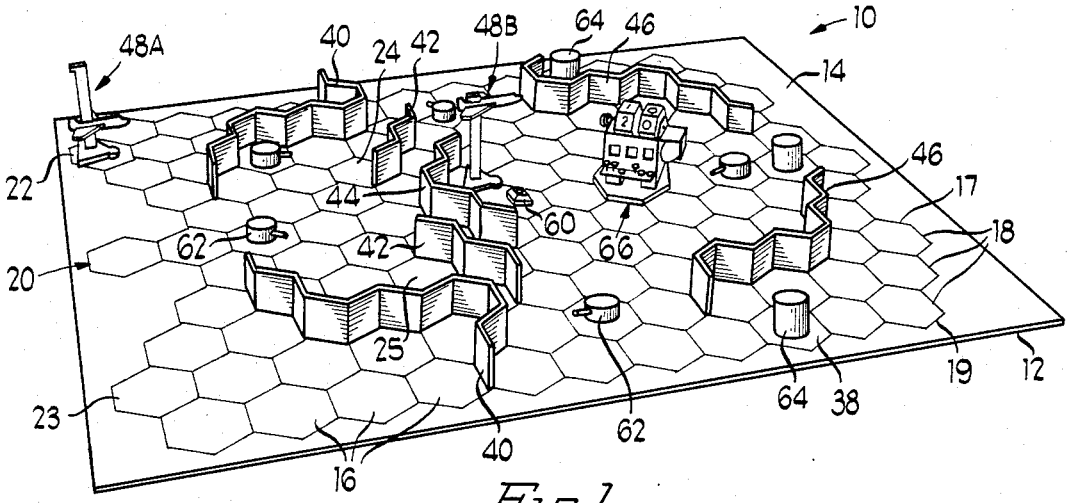
Fig 1
Fig 2
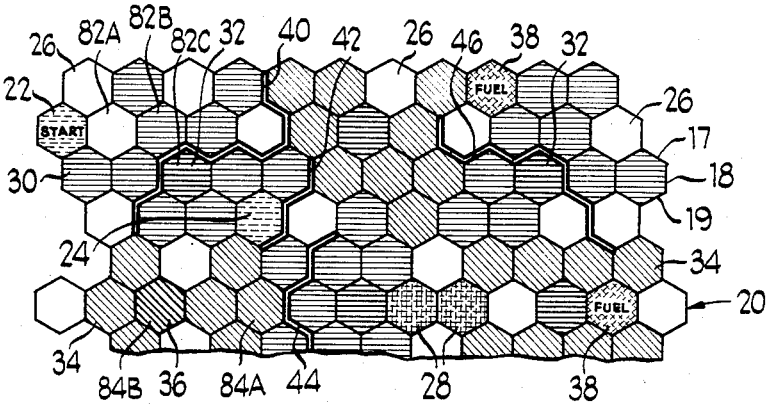
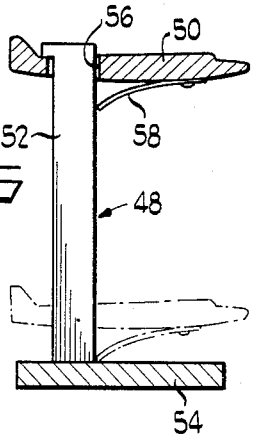
Fig 5
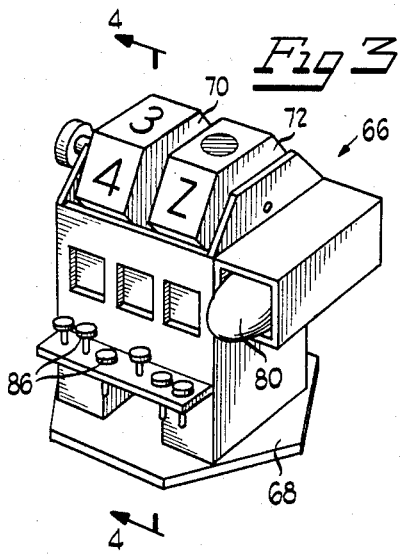
Fig 3
Fig 4
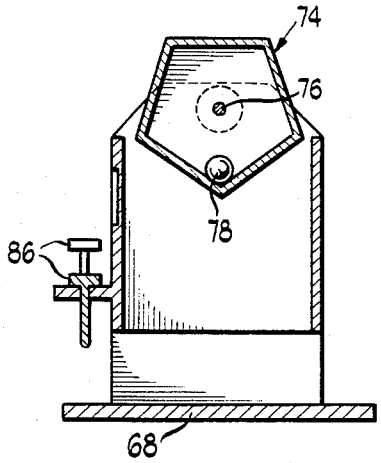
Fig 6
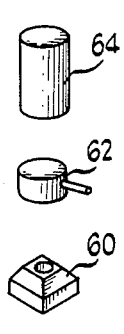

BOARD GAME WITH CHANCE DEVICE PLAYING PIECE

BACKGROUND OF THE INVENTION

1. Field of the Invention

This invention relates generally to board games and more particularly to board games that embody a theme suggested by other media or events.

2. Background Art

Board games, particularly those based on various themes suggested by real life events or occurrences, or by other games, have long been popular. For example, prior art patents assigned to the assignee of the present invention disclose board games embodying the themes of: a beauty contest, U.S. Pat. No. 3,861,686; investment, U.S. Pat. No. 3,865,379; invention, U.S. Pat. No. 3,885,792; golf, U.S. Pat. No. 3,989,249; magic acts, U.S. Pat. No. 3,989,251; fast food franchises, U.S. Pat. No. 3,994,499; and the legendary creature "BIG FOOT", U.S. Pat. No. 4,128,246. Recently, video games, both the types playable in arcades and by means of adapters on home television sets, have become popular pastimes. Such video games have also provided themes for board games. There are currently board games based on the Bally/Midway "PAC-MAN", Nintendo "DONKEY KONG" and Sega "FROGGER" video games which are disclosed respectively in copending applications Ser. No. 339,850 filed Jan. 18, 1982, issued as U.S. Pat. No. 4,448,421; Ser. No. 424,354 filed Sept. 27, 1982, issued as U.S. Pat. No. 4,484,747; and Ser. No. 426,368 filed Sept. 29, 1982 now abandoned, all of which are assigned to the assignee of the present invention. There remains, however, a need for additional portable board games that provide entertaining, challenging and competitive play of a game employing a theme suggested by popular video games.

SUMMARY OF THE INVENTION

The present invention is concerned with providing a board game based on the theme of the Sega "ZAXXON" video game which affords entertaining and challenging play including providing for strategic selection of options by the player. These and other objects and advantages of the invention are achieved by providing a game board having a substantially horizontal playing surface defined by an array of hexagonal spaces including a player start space and a target located on the playing surface remote from the start. Vertical walls are disposed between certain adjacent spaces obstructing some of the paths that would otherwise be available from the player's start to the target. The player's token is movable in both a horizontal plane from space to space along the playing surface and in a vertical plane permitting the player to strategically circumnavigate the walls in moving from the start to the target. Danger zones are interposed between the start and the target with the effectiveness of the danger zones controlled by the presence of certain playing pieces which the player may choose to attempt to remove in order to render the zone harmless. Other playing pieces are positioned on the board which the player may obtain to assist him in his ultimate goal of hitting the target to win the game. However, as in the "ZAXXON" video game, the target, represented by an armed robot playing piece, can shoot back and eliminate the player or otherwise reduce his accomplishments up to that point. The target robot also carries chance means for determining the extent of player movement in any one turn plus indicating which of the danger zones have been activated in that turn. In addition to providing competitive play for two players, the game may be played in a solitaire mode.

BRIEF DESCRIPTION OF THE DRAWINGS

For a better understanding of the present invention, reference may be had to the accompanying drawings in which:

FIG. 1 is a perspective view of an embodiment of the present invention showing a game in progress;

FIG. 2 is a reduced, partial top plan view of the game board with spaces lines for color;

FIG. 3 is an enlarged perspective view of the game target;

FIG. 4 is a sectional view of the game target taken generally along the line 4–4 of FIG. 3;

FIG. 5 is an enlarged side elevational view of the player token partially in section; and FIG. 6 is an enlarged perspective view of additional game pieces.

DETAILED DESCRIPTION OF THE PREFERRED EMBODIMENT

Referring now to the drawings in which like parts are designated by like reference numerals throughout the several views, there is shown in FIG. 1 a board game 10, having a game board 12, with a substantially horizontal playing surface 14, defined by an array of congruent hexagonal spaces 16. As is shown in FIGS. 1 and 2, each hexagonal space 16 is stacked in three intersecting files 17, 18 and 19. Each file abuts an adjacent offset file such that each hexagonal space, except for those along the peripheral boundaries, abuts one or more hexagonal spaces. Board 12 is symmetrical about the central file 20.

The playing surface 14 is divided into a number of different zones with each zone including one or more hexagonal spaces. Thus, there is start space 22 and 23 for each of the players which may conveniently be identified by colors such as silver and gold respectively. Each of the players is also provided with a rest space 24 and 25 respectively which, like the start space, is immune from danger. A series of safe zones 26 are disposed about the playing surface and are indicated by the color white. In this embodiment the target zone 28 comprises two adjacent hexagonal spaces 16 located in the central file 20 and colored yellow to distinguish them from other zones. A number of multi-space danger zones of two different types are disposed about the board. Each of the danger zones has a number of spaces and includes a space designated for the placement of a playing piece which controls the effectiveness of the zone. Thus, there are a plurality of available paths crossing various danger zones from each start space 22 and 23 to the target zone 28.

Missile zones 30 indicated by a blue color have a missile location 32 designated by a darker blue color, a dot, or some other convenient indicia. Similarly, cannon zones 34 are indicated by green and include a cannon emplacement 36 designated by a darker green or other indicia. There is a greater concentration of the danger zones 30 and 34 with less of the safe white zones 26 in proximity to the target zone 28 than in the portion of the playing surface nearer the player start zones 22 and 23. Also located in the target zone end of the board, as opposed to the player start end, are a number of single space fuel zones 38 which may conveniently be identified by the color orange. The color coding selected for this embodiment is indicated with respect to the target zone 28, the missile zones 30, the cannon zones 34, and the start space 22 in FIG. 2 from which the balance of one side the board 12 that is symmetrical about the central file 20 has been omitted.

A number of multi-planed vertical walls 40, 42, 44 and 46, all of equal height, are disposed along lines formed by adjacent hexagonal spaces. Each wall obstructs movement upon the playing surface 14 between adjacent spaces that are separated by the wall. In this embodiment the walls are disposed in a preselected pattern that obstructs less than all of the available paths between the start spaces 22 and 23 and the target zone 28. The walls are conveniently molded of a plastic material with integrally formed pins (not shown) that fit into mating apertures (not shown) in the board 12.

Each of the players is provided with a token 48 which includes a marker 50 that is in the form of a fighter plane or rocket. Marker 50 is mounted for vertical movement on a standard 52 that is affixed to base 54. Accordingly, the marker 50 may be moved from a first lower position adjacent the base 54 and the playing surface 14, as illustrated by the token 48A in FIG. 1 and the phantom line showing in FIG. 5, to a second higher position above the height of the walls 40, 42, 44 and 46 as illustrated by token 48B in FIG. 1. To provide for the vertical movement and retention in either the lower or higher position, the marker 50 has a slot 56 that is somewhat larger than the cross-section of the standard 52 and a flat spring 58 retains the marker 50 in the selected position on the standard 52.

At the beginning of play a playing piece simulating a missile launching silo 60 is placed on each missile location 32. Similarly, each cannon zone emplacement 36 has a cannon playing piece 62 at the beginning of the game. The single hexagonal space fuel zones also each contain a playing piece in the form of a tall cylindrical fuel tank 64. Each of the playing pieces 60, 62 and 64 may be colored to correspond with the space on which it is placed. The missile silos 60, cannon 62 and fuel tanks 64 may be removed from the board 12 during play of the game but are otherwise stationary.

A target 66 in the form of an armoured robot is initially positioned on one of the two hexagonal spaces forming the yellow 28. The robot 66 has a hexagonal base 68 that is congruent with the spaces 16 and bears chance determining devices 70 and 72. Each of two chance devices is in the form of a hollow, five-faced drum 74 mounted for rotation on axis 76 that is supported by the robot 66. As is best illustrated in FIG. 4, hollow drum 74 carries a ball bearing 78 which provides an audio effect as the drum rotates. The ball 78 also helps to bring the spinning drum to rest with one of the five faces oriented upwardly as illustrated in FIG. 1. Chance device 70 has the five faces serially numbered from "1" to "5". The faces of chance device 72 include two fire missiles and two fire cannons faces which may conveniently be indicated by blue and green dots respectively, plus one robot target firing indication which may consist of the letter "Z". The result of the chance device 72 determines the player susceptibility to the defenses in each turn. A projectile 80 carried by the robot target 66 faces in a direction transverse to one of the sides of the robot base 68 and defines the forward facing firing direction of the robot.

Board game 10 provides for competitive play by two players, each of whom adopts a token 48 and the respective starting space 22 or 23. The players may determine which is to go first by spinning the chance drum 70 and the player obtaining the higher number starts, or other means may be employed to determine which player goes first. Board 12 is set up with the walls 40, 42, 44 and 46 in place, a missile silo 60 on each missile location 32, a cannon 62 on each emplacement 36, a fuel tank 64 on each fuel zone 38, and the robot 66 on one of the two yellow target spaces. Marker 50 of each of the player tokens 48 starts out in the lower position as illustrated by 48A in FIG. 1. Each player is provided with three fuel allocations at the onset of the game.

At the start of each turn the player spins both of the chance selection drums 70 and 72. On the first move the defense chance indicator 72 is not yet of consequence because the player is starting from a position that is not subject to missile, cannon or robot fire. Accordingly, the player is free on the first turn to make the number of moves indicated on the number chance selection device 70. The player's moves may be any combination of horizontal and vertical moves with the limitations that the player may only move from an adjacent hexagonal space to another adjacent space and may not move through a wall while the token marker 50 is in the lower position. However, once the player moves the marker 50 to the upper position as illustrated by token 48B in FIG. 1, the player may pass over the wall or shoot over the wall. Thus, the player starting at 22 and obtaining "5" on the drum 70 may choose to move along the path 82A, 82B and 82C in the following manner:

Move 1—From start 22 to white space 82A;
Move 2—From space 82A to green space 82B;
Move 3—Raise marker 50 to upper position;
Move 4—Fly over wall 40 to space 82C; and
Move 5—Lower marker 50.

The player may continue movement of the token in the elevated position to any hexagonal space adjacent to 82C as the fifth move rather than descending back down to ground level. However, such a move subjects the player to the danger of defensive missiles on the next turn since all of the adjacent hexagonal spaces are within the missile zone 30 controlled by missile silo 60 on space 82C. Landing on that space with marker 50 in the lower position has the advantage of "knocking out" the missile silo 60.

Any time the player ends a move with the token on a missile silo 60, cannon 62, fuel tank 64, or the opponent's token with the marker 50 in the lower position, the player succeeds in removing that playing piece from its position. The effect of removing the opponent's token is to return it to the respective start space 22 or 23. Landing on and capturing a fuel tank 64 adds a fuel credit to the three allocations with which the player starts the game and the fuel tank is then removed from further play. When a missile silo 60 or cannon 62 is removed, it then stays out of play for the rest of the game with the result that the zone of connected hexagonal spaces is disarmed. Thus, removal of the missile silo 60 by descending to space 82C in the exemplary first move disarms the zone of connected blue spaces and renders it ineffective for both players for the rest of the game.

If a player is positioned on an effective armed missile zone and the defense chance indicator 72 spun at the beginning of the turn comes up with a fire missile indication, the player is then "shot down" and has the choice of either returning to the respective start space or giving up a fuel allocation. The cannon zones 34 are controlled in a similar manner by the placement of cannons 62. Board 12 may be arranged with an overlap between danger zones so that certain spaces are subjected to a "cross-fire". In such an alternative "knocking out" one of the armaments would not totally neutralize the overlapped space.

Should the robot firing indication "Z" turn up on the defense chance indicator 72 at the beginning of a player turn, the robot target 68 is moved any combination of rotational and linear moves totalling the result of the number chance selector 70 within the yellow target zone 28 by the opponent in an attempt to align the forward facing direction of the robot projectile 80 with the player token along a file 17, 18 or 19. If the opponent can so align the robot 66, and the player token is not behind one of the walls, then the player is "shot down" and must return the token to the start position. In this embodiment the robot projectile 80 has unlimited range, however as an alternative, the number on chance device 70 could also be used to determine the range of the projectile 80 for that particular turn.

Whenever the player token 48 is positioned on a file containing the robot target 66 and the player is not "shot down", the player may attack the robot. In an attack by the player on the robot, the number turned up on the chance device 70 determines the effective range of fire by the player. Thus, if the player token 48 is positioned on space 84A and a "5" turns up on the wheel 70 along with a missile fire indication on the defense wheel 72 or a cannon fire indication and the cannon 62 on space 84B has previously been "knocked out", the player is assured of a hit on the robot target 66. Even if the player marker 50 is in the lower position, the marker can be elevated over wall 44 as one move leaving a range of four spaces which will hit the target 66 no matter which of the two spaces it occupies within the target zone 28. However, if the target 68 were on the more remote space within the zone 28 and the player only obtained a "4" on the wheel 70, the target could not effectively be attacked if the marker 50 was in the lower position since the walls 40, 42, 44 and 46 not only obstruct movement of the player token in its lower position but also block its attack fire just as the walls block the robot projectile 80.

It will be appreciated that space 84A is a rather advantageous one since once the cannon 60 is eliminated from space 84B, a player could as previously described raise the marker 50 from the lower position, launch an attack across the three spaces to the nearest space in the target zone 28 and then descend again behind the safety of the wall 44. Thus, a player could continue to remain in the virtually invulnerable position and launch repeated attacks upon the target 66 until the requisite number of hits for completion of the game were scored. Accordingly, the game would be reduced to a mere spinning of the number wheel 70 unless the apparent marker landed on the same space 84A and "knocked out" the player. To avoid such an occurrence, the player is required to return to the designated rest space 24 or 25 after launching an attack on the target 68. While it is possible for the player to return from the rest space to space 84A upon obtaining a "2" or greater number on the chance device 70, the requirement for at least the one additional move has been found to avoid a "runaway" game by any one player. Other alternatives to reduce the advantage of space 84A would be to remove the obstruction of wall 44 from the central file 20 and subject the space to the "cross-fire" of more than one defense zone.

It has been found that requiring a player to score three hits on the target 66 in order to successfully complete the game provides for entertaining and challenging play that does not require an inordinate amount of time. For this purpose the robot target 66 may be provided with hit counters 86 to record the hits in the form of "push-pull" pegs carried in apertures on the robot. The play of the game may also be increased by requiring a player to have captured one each of the missile silos 60, cannons 62, and fuel tanks 64 prior to being eligible to launch an attack upon the target 66. As another alternative, the player may be required to complete a predetermined path or circuit around the board to become eligible to attack the robot 66.

Without substantially altering the play of the game as previously described, it may be enjoyed by a solitaire player. In such play, there will be moments the solitaire player will be found in the somewhat dubious position of being both the attacker and the defender of the robot target 66. However, by requiring the player in such a situation to have to move the robot to a position that would shoot down the player token if permitted by the result on number drum 70 but not to otherwise move the robot target, the player is effectively precluded from arranging play of the robot target to provide for an easy victory.

While a particular embodiment of the present invention has been shown and described, changes and modifications, in addition to the ones already described, will occur to those skilled in the art particularly with respect to the arrangement of the spaces on the board and the rules of play. It is intended in the appended claims to cover all such changes and modifications as come within the true spirit and scope of the invention.

What is claimed as new and desired to be secured by Letters Patent is:

1. A board game comprising:

a game board having a substantially planar surface;

a plurality of playing spaces on the surface;

first indicia on the board identifying at least one of the spaces as a player start position;

second indicia on the board defining a contiguous number of the spaces as a target zone remote from the start position;

a moveable target piece positionable on spaces within the target zone;

a plurality of available paths extending from space to space between the start position and the target zone;

a moveable player token for each player;

at least one three dimensional wall with a top disposed transverse to the surface across at least some of the available paths;

the token including a base and a marker slidably mounted on the base for movement from a first lower position adjacent the base and below the top of the wall to a second upper position remote from the base and above the top of the wall;

the moveable marker being biased into engagement with the base to retain the marker in the first or second position;

first and second chance means;

the first chance means bearing number indicia;

the second chance means bearing some indicia indicating the target piece;

defensive playing pieces;

third indicia on the board indicating other contiguous numbers of the spaces comprising portions of some of the available paths as danger zones; and fourth indicia on the board designating one of the spaces of each of the danger zones for placement of a defensive playing piece.

2. The board game of claim 1 in which the second chance means bears some indicia indicating the defensive pieces.

3. The board game of claim 1 in which:

there is a plurality of walls;

the walls are removable from the board; and means on the board dictate the placement of the walls between danger zones.

4. The board game of claim 1 including:

fifth indicia on the board identifying a number of the spaces comprising portions of some of the available paths as single space fuel zones; and fuel playing pieces positionable on the fuel zones.

5. The board game of claim 4 including sixth indicia on the board indicating a number of the spaces comprising portions of some of the available paths as safe zones.

6. The board game of claim 5 in which the safe zones are disposed between danger zones.

7. The board game of claim 6 including means on the moveable target piece defining the forward facing direction of the moveable target piece.

8. A board game comprising:

a game board having a substantially planar surface;

a plurality of playing spaces on the surface;

first indicia on the board identifying at least one of the spaces as a player start position;

second indicia on the board defining a contiguous number of the spaces as a target zone remote from the start position;

a moveable target piece positionable on spaces within the target zone;

a plurality of available paths extending from space to space between the start position and the target zone;

a moveable player token for each player;

at least one three dimensional wall with a top disposed transverse to the surface across at least some of the available paths;

the token including a base and a marker slidably mounted on the base for movement from a first lower position adjacent the base and below the top of the wall to a second upper position remote from the base and above the top of the wall;

the moveable marker being biased into engagement with the base to retain the marker in the first or second position;

defensive playing pieces;

third indicia on the board indicating other contiguous numbers of the spaces comprising portions of some of the available paths as danger zones; and fourth indicia on the board designating one of the spaces of each of the danger zones for placement of a defensive playing piece.

9. The board game as claim 8 in which:

there is a plurality of walls;

the walls are removable from the board; and means on the board dictate the placement of the walls between danger zones.

10. The board game of claim 9 including:

fifth indicia on the board identifying a number of the spaces comprising portions of some of the available paths as single space fuel zones; and fuel playing pieces positionable on the fuel zones.

11. The board game of claim 10 including sixth indicia on the board indicating a number of the spaces comprising portions of some of the available paths as safe zones.

12. The board game of claim 11 in which the safe zones are disposed between danger zones.

13. The board game of claim 8 including:

fifth indicia on the board identifying a number of the spaces comprising portions of some of the available paths as single space fuel zones; and fuel playing pieces positionable on the fuel zones.

14. A board game comprising:

a game board having a substantially planar surface;

a plurality of playing spaces on the surface;

first indicia on the board identifying at least one of the spaces as a player start position;

second indicia on the board defining a contiguous number of the spaces as a target zone remote from the start position;

a moveable target piece positionable on spaces within the target zone;

a plurality of available paths extending from space to space between the start position and the target zone;

a moveable player token for each player;

at least one three dimensional wall with a top disposed transverse to the surface across at least some of the available paths;

the token including a base and a marker slidably mounted on the base for movement from a first lower position adjacent the base and below the top of the wall to a second upper position remote from the base and above the top of the wall;

the moveable marker being biased into engagement with the base to retain the marker in the first or second position;

first and second chance means; and both of the chance means being carpied by the moveable target piece.

15. The board game of claim 14 in which the first and second chance means each comprise a multi-faced drum mounted for rotation on the moveable target piece.

16. The board game of claim 15 in which the drum is hollow and contains a ball.

* * * * *